United States Patent [19]

Kato

[11] 4,169,681

[45] Oct. 2, 1979

[54] LIQUID STIRRING APPARATUS

[75] Inventor: Sei Kato, Nagoya, Japan

[73] Assignee: Nihon Senshoku Kikai Kabushiki Kaisha, Aichi, Japan

[21] Appl. No.: 521,334

[22] Filed: Nov. 6, 1974

[51] Int. Cl.[2] ..... B01F 7/18

[52] U.S. Cl. ..... 366/244; 74/23; 366/255; 366/289

[58] Field of Search ..... 259/116, 118, 123, 124, 259/102, 112, 113, 99; 74/23; 366/244, 255, 289

[56] References Cited

U.S. PATENT DOCUMENTS

| | | | |
|---|---|---|---|
| 141,480 | 8/1873 | Archer | 259/113 |
| 1,438,281 | 12/1922 | Westerman | 259/102 |
| 2,692,125 | 10/1954 | Light | 259/116 |
| 2,898,094 | 8/1959 | O'Neill | 259/116 |
| 3,074,786 | 1/1963 | Duthie | 259/123 |

*Primary Examiner*—Robert W. Jenkins
*Attorney, Agent, or Firm*—Gunn & Lee

[57] ABSTRACT

An apparatus for stirring a liquid, having a stirring blade which is not only capable of rotating, but simultaneously moving in a vertical direction. The number of rotations of the stirring blade during one stoke of its vertical movement may be altered to best suit the requirements of a particular type of liquid to be stirred. The apparatus is especially suitable for stirring a highly viscous liquid uniformly.

4 Claims, 2 Drawing Figures

LIQUID STIRRING APPARATUS

BACKGROUND OF THE PRESENT INVENTION

This invention relates to an apparatus for stirring a highly viscous liquid, and more particularly, to such stirring apparatus having a stirring blade which is capable of both horizontal rotation and vertical movement simultaneously for the uniform stirring of the liquid.

According to the apparatus known in the prior art, a liquid has been stirred exclusively by the rotation of a stirring blade secured to a shaft. The apparatus has very often failed to stir the liquid satisfactorily, especially when the liquid is highly viscous. The liquid in the corners, top and bottom of a tank is not drawn to the stirring blade to be stirred satisfactorily. In view of those difficulties which are often attributable to the viscosity of the liquid to be stirred, it has been proposed to employ a plurality of stirring blades to cause circulation of the liquid through a larger space in the tank, and also to preheat the liquid to be stirred in order to lower its viscosity. But such proposals have turned out to require a larger, more complicated and hence more expensive apparatus.

It is, therefore, an object of this invention to provide an improved liquid stirring apparatus having a stirring blade adapted by a simple mechanism for simultaneous horizontal rotation and vertical movement so that the blade can reach virtually any portion of the volume of a tank holding the liquid to thereby stir the liquid uniformly in a short time.

It is another object of this invention to provide a liquid stirring apparatus wherein the number of rotations of the stirring blade during one stroke of its vertical movement can be selected as desired to best suit the requirements of a particular type of liquid to be stirred.

It is still another object of this invention to provide a liquid stirring apparatus wherein the stroke of vertical movement of the stirring blade can be changed to suit the depth of a liquid tank in addition to alteration of the number of rotations of the blade.

It is a further object of this invention to provide a liquid stirring apparatus which can successfully be operated without causing damaging vibration.

SUMMARY OF THE INVENTION

The apparatus according to this invention comprises an upright rotary shaft which is not only capable of being rotated about its own axis, but being simultaneously moved in a vertical direction. A stirring blade is secured to the lower end of the rotary shaft, and a universal joint is attached to the upper end of the same shaft. A pair of crank shafts which are horizontally disposed in alignment with each other are rotatably supported by openings in the wall of a housing. A crank throw is attached to the inner end of each of the crank shafts, and the two cranks are connected with each other by a crank pin. A gear box is interposed between the two cranks, and rotatably attached to the crank pin. A driving bevel gear and a driven bevel gear meshed with the driving bevel gear are housed in the gear box. The driving bevel gear is secured to the crank pin, while the driven bevel gear is secured to the upper end of a drive shaft extending into the gear box through its bottom. The lower end of the driving shaft is connected with the universal joint. When one of the crank shafts is driven by a motor or the like, the crank pin and the gear box are caused to resolve about the crank shafts. At the same time, the driven bevel gear is driven by the driving bevel gear, and the drive shaft to which the driven bevel gear is secured is also rotated while moving up and down. Accordingly, the rotary shaft to which the stirring blade is secured is caused to rotate and move vertically. Thus, the stirring blade is caused to move up and down while rotating throughout the tank, so that the liquid in the tank may be stirred uniformly.

DESCRIPTION OF THE PREFERRED EMBODIMENT

Figure 1:
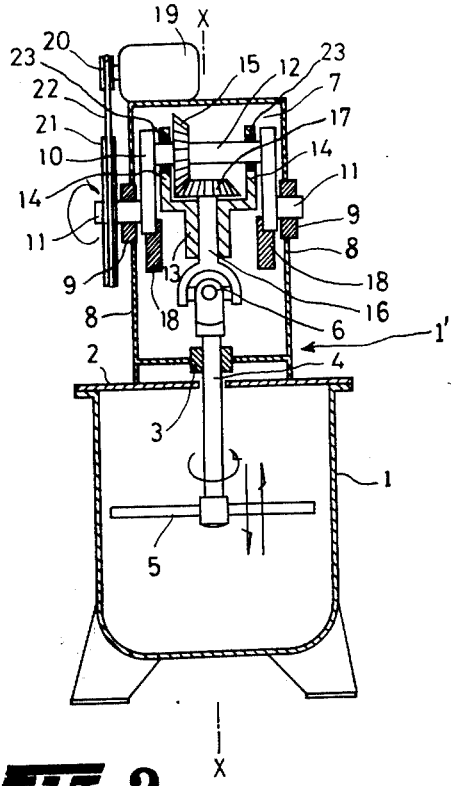
FIG. 1 is a front elevational view, substantially in section, of a preferred embodiment of this invention.

Referring to FIG. 1 of the drawings, an apparatus according to this invention is generally designated by the numeral 1', and it comprises a tank 1 for holding the liquid to be stirred and a housing 7 mounted on the tank 1. The tank 1 holding a highly viscous liquid therein is generally closed at the top thereof with a cover 2, and the housing 7 which is substantially cylindrical is vertically mounted on the cover 2 of the tank 1. The housing 7 is provided with a bearing assembly 3 at the bottom center thereof. An upright rotary shaft 4 is provided through the bearing assembly 3, and supported thereby in such a manner that the shaft 4 is not only capable of rotating about its own axis, but also simultaneously of moving vertically. A stirring blade 5 is secured to the lower end of the rotary shaft 4, while a universal joint 6 is attached to the upper end thereof.

Two bearing assemblies 9 are provided on the wall 8 of the hosuing 7. The bearings 9 are located at diametrically opposite positions of the wall 8, and define a horizontal axis. Two crank shafts 11 having a crank 10 are rotatably supported on the bearings 9. A crank pin 12 is secured between the cranks 10, and connects them together. A gear box 14 is interposed between the cranks 10, and rotatably attached to the crank pin 12 by the use of bearings 23. The gear box 14 is provided with a bearing assembly 13 at the bottom. A first bevel gear 15 is housed in the gear box 14, and positioned adjacent to the inner surface of one wall of the gear box 14. The bevel gear 15 is journaled on the crank pin 12 and is held in position by a set screw, key and keyway or other suitable means. A shaft 16 is rotatably carried through the bearing 13. A driven bevel gear 17 is secured to the upper end of the driving shaft 16, and is meshed with the driving bevel gear 15. The lower end of the driving shaft 16 is connected with the universal joint 6.

The driving shaft 16 and the rotary shaft 4 are arranged to deflect at the universal joint 6 in a plane defined by the line X—X in FIG. 1 and which is perpendicular to the pin 12. Accordingly, when the rotation of the cranks 10 causes the gear box 14 to revolve about the crank shafts 11, the driving shaft 16 is swung to and fro and also moves vertically without departing from the plane X—X, while it is rotated by the bevel gears 15 and 17. A selected balance-weights 18 are attached to the cranks 10 opposite from the end which support the crank pin 12. The balance-weights 18 are provided for compensating for the moment of the rotary shaft 4, the stirring blade 5 and so forth about the crank shafts 11, and stablize operation of the apparatus and reduce or eliminate vibration.

A motor 19 is mounted on the top of the housing 7. A pulley 20 is secured to the motor shaft and another pulley 21 is secured to one of the crank shafts 11. A belt 22 transfers power from the motor 19 to the crank shaft 11.

Figure 2:
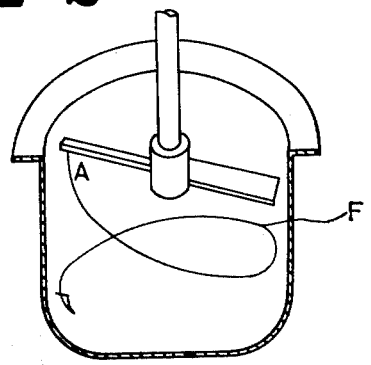
FIG. 2 is an explanatory view showing the path of movement of the stirring blade.

In operation, the motor 19 is started, and the rotary motion of the motor 19 is transmitted to one of the crank shafts 11 through the pulley 20, the belt 22 and the pulley 21, whereupon the crank shaft 11 is rotated. Then, the gear box 14 rotatably attached to the crank pin 12 is caused to revolve about the crank shafts 11, and the driving bevel gear 15 secured to be crank pin 12 causes the driving shaft 16 to rotate via the driven bevel gear 17. Since the lower end of the driving shaft 16 is connected to the rotary shaft 4 by the universal joint 6, the revolution of the crank shaft (and the gear box 14) causes the rotary shaft 4 to move vertically while rotating about its own axis. Thus, the stirring blade 5 secured to the lower end of the rotary shaft 4 is caused to move along a spiral path as shown in FIG. 2, and stir uniformly the viscous liquid contained in the tank 1.

The distance of vertical movement of the stirring blade 5 depends on the distance between the crank shafts 11 and the crank pin 12. Accordingly, if the crank pin 12 is designed to be changeable in position, the distance of vertical movement of the stirring blade 5 can be changed. Moreover, if the gear ratio of the driving bevel gear 15 and the driven bevel gear 17 is changeable, the number of rotations of the stirring blade 5 during one stroke of its vertical movement can be changed to suit the requirements of a particular type of liquid to be stirred. Furthermore, if the gear ratio of the driving bevel gear 15 to the driven bevel gear 17 something other than an integer, the stirring blade 5 can be made to change its position in the tank 1 gradually on each cycle of operations, and it will not return to its original position until after the rotary shaft 4 has completed the number of rotations equal to the least common multiple of the numbers of the teeth of the two bevel gears 15 and 17, so that the liquid in the tank can be stirred uniformly.

What is claimed is:

1. An apparatus for stirring a liquid, comprising:

an upright rotary shaft supported for positioning in a liquid in a container and adapted for simultaneous rotation about its own axis and vertical movement;

a stirring blade secured to the lower end of said rotary shaft;

a means for driving said rotary shaft to impart simultaneous rotary and vertical oscillatory movements thereto, said means including a crank means rotatably supported for rotation about an axis and a motor for driving said crank means;

a crank pin connected to said crank means;

a gear box rotatably attached to said crank pin;

a first bevel gear in said gear box and secured to said crank pin;

a second bevel in said gear box and meshed with said first bevel gear;

a drive shaft extending downwardly from said gear box and engaged with said second bevel gear; and, universal joint means connecting said drive shaft and said rotary shaft to rotate said rotary shaft.

2. The apparatus as defined in claim 1 including a housing mounted above said container for housing said driving means.

3. The apparatus as defined in claim 1 wherein balance-weight means is provided on said crank means.

4. The apparatus of claim 1 wherein said gear box is maintained in a generally upright position during operation by a bearing means supporting said gear box on said crank pin.

* * * * *